United States Patent [19]

Wright

[11] Patent Number: 4,497,341

[45] Date of Patent: Feb. 5, 1985

[54] PAINT COLOR CHANGE VALVE ASSEMBLY FOR RECIRCULATING PAINT SYSTEM

[75] Inventor: Dolph D. Wright, Union Lake, Mich.

[73] Assignee: General Motors Corporation, Detroit, Mich.

[21] Appl. No.: 525,130

[22] Filed: Aug. 22, 1983

[51] Int. Cl.[3] ..... E30B 7/07

[52] U.S. Cl. ..... 137/563; 137/501; 137/504; 137/606; 239/125

[58] Field of Search ..... 137/501, 504, 606, 563; 239/125

[56] References Cited

U.S. PATENT DOCUMENTS

| | | | |
|---|---|---|---|
| 2,266,354 | 12/1941 | Christenson et al. | 137/563 |
| 2,401,124 | 5/1946 | Walker et al. | 137/563 |
| 2,567,818 | 9/1951 | MacCracken | 239/125 |
| 2,578,272 | 12/1951 | Thompson | 239/125 |
| 3,403,695 | 10/1968 | Hopkins | 137/563 |
| 3,572,366 | 3/1971 | Wiggins | 137/563 |
| 3,816,025 | 6/1974 | O'Neil | 137/563 |
| 4,390,126 | 6/1983 | Buchholz et al. | 137/563 |

*Primary Examiner*—Alan Cohan
*Assistant Examiner*—John A. Rivell
*Attorney, Agent, or Firm*—William A. Schuetz

[57] ABSTRACT

A recirculating paint apparatus comprising a main body provided with a plurality of radially extending openings in communication with a main axially extending delivery channel, and a plurality of selectively operable valve assemblies for controlling communication between different color paints and the delivery channel is disclosed. Each paint is recirculated through its associated valve assembly right up to its valve for controlling flow through an orifice in communication with the common delivery channel so that all areas are subject to recirculating flow and any settling out of pigments or solids in the paint is prevented or minimized.

2 Claims, 4 Drawing Figures

PAINT COLOR CHANGE VALVE ASSEMBLY FOR RECIRCULATING PAINT SYSTEM

The present invention relates to multi-color paint spray apparatus and, more particularly, to a recirculating multi-color paint spray apparatus having valve assemblies for controlling flow of different color paints to a common paint channel and in which the paint is continuously circulated through all areas of the valve assembly to minimize pigments in the paint from settling out.

Heretofore, recirculating paint spray apparatus or systems have been provided which included a plurality of selective operable valve assemblies for delivering different color paints to a common paint channel for delivery to a spray nozzle or gun. In such systems, it is also known to locate the valve assemblies radially of the common channel. Examples of such systems are disclosed in U.S. Pat. Nos. 3,201,048 and 3,373,762, which are assigned to the same assignee as the present invention. It is also known to use recirculating paint systems in which a pressure regulating valve assembly mounted on a housing of the spray gun is used for regulating the flow of paint. Such a system is shown in U.S. Pat. No. 4,368,852. In this latter system, the regulator valve causes the paint to be constantly recirculated to its reservoir, but does not constantly recirculate paint through all parts of the valve assembly.

A disadvantage of prior recirculating paint systems is that the paint is not recirculated throughout the valve assemblies or systems with the result that there are chambers or cavities which are not subject to recirculation. In normal operation of such paint systems, certain colors must be constantly available, but are seldom used. In that case, solid pigments in the paint can settle out in such cavities and form a semi-solid mass that when delivered to the spray gun or applicator can cause malfunction of the spray gun or applicator.

The present invention overcomes this disadvantage by providing a recirculating paint apparatus or system in which the paint is completely recirculated through its associated valve assembly right up to its valve for controlling flow through an orifice in communication with a common delivery channel. Thus, all areas are subjected to recirculation and hence, settling out of any pigments in the paint is minimized or eliminated. In addition, by arranging the valve assemblies radially of the common channel a length to diameter ratio for the common channel in the first order of magnitude can be employed. This reduces the cost and time for cleaning the channel when switching from one color paint to another color paint.

Accordingly, an important object of the present invention is to provide a new and improved recirculating paint spray apparatus or system having a plurality of valve assemblies for controlling delivery of different color paints to a common paint channel and in which the paints are completely recirculated through their respective valve assemblies so that all cavities are subjected to recirculation whereby settling out of any pigments carried by the paint is minimized or eliminated.

Another object of the present invention is to provide a new and improved paint spray apparatus or system, as defined in the preceding object, and in which the valve assemblies each have a reciprocable poppet for opening and closing an orifice in communication with a main paint channel and in which the paint is circulated right up to the poppet and thence through the remainder of the valve assembly so that all cavities of the valve assembly in communication with the paint are subjected to circulatory paint flow so that settling out of the pigments in the paint is minimized or eliminated.

Yet another object of the present invention is to provide a new and improved multi-color, recirculating paint spray apparatus or system having a body provided with a main channel for delivering paint to a spray applicator, a plurality of radially extending openings in communication with the main channel and terminating in a valve seat adjacent the main channel, a plurality of selectively operable valve assemblies carried by the body for controlling delivery of different colored recirculating paints through the main channel, and in which each valve assembly comprises a poppet for seating against the valve seat, a tube extending through the radial opening and having one end secured to the poppet and its other end secured with a reciprocable diaphragm and with the tube having a diameter which is less than its associated radial opening and a plurality of through apertures closely adjacent the poppet, spring means for normally biasing the diaphragm to hold the poppet in a closed position in which it blocks communication with the main channel and causes the recirculating paint to flow around the tube through the apertures in the tube thence through the tube and the remainder of the valve assembly whereby the paint is caused to flow completely through the valve assembly right up to the poppet valve, and a selectively operable actuating means for moving the diaphragm and poppet valve to an open position in which it permits paint to flow to the main channel as well as through the valve assembly.

A further object of the present invention is to provide a new and improved multi-color recirculating paint spray apparatus or system, as defined in the preceding object, and wherein the valve assembly includes a flow compensation valve means downstream of the poppet valve and tube to maintain a constant rate flow of paint through the valve assembly and system.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 1:
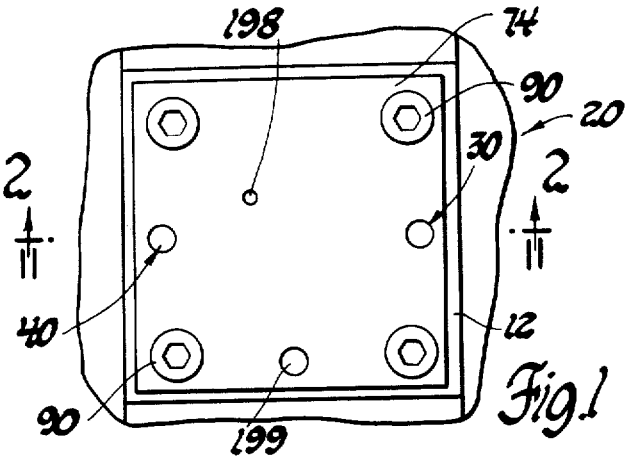
FIG. 1 is a fragmentary top plan view of part of the novel paint spray apparatus of the present invention.

Referring to the drawings, a novel multicolor, recirculating paint spray apparatus or system A incorporating the provisions of the present invention is thereshown. The paint spray apparatus A comprises a main body or housing 10 having a plurality of outer flat sides 12 and an axially extending main channel or bore 14 for delivering paint to a suitable spray gun or paint applicator (not shown). The main body 10 also includes a plurality of radially extending openings or bores 16, each of which is in communication with the main channel 14. The openings 16 adjacent their ends in communication with the main channel 14 are of a lesser diameter to define annular tapered valve seats 18.

The paint spray apparatus A also includes a plurality of paint change valve assemblies 20 (only one of which is shown) secured to the flat sides of the main body 10. The valve assemblies 20 each include a poppet valve 24 for controlling communication between their respective radial openings 16 and the main channel 14. Each valve assembly 20 controls communication on one paint color from a suitable source to the main channel 14. Since all of the valve assemblies 20 would be identical, only one is shown in the drawings and will be described in detail. Suffice it to say, that the valve assemblies 20 would be located radially around the main body 10 and in a manner such as shown in the aforementioned U.S. Pat. Nos. 3,201,048 and 3,373,762.

Figure 4:
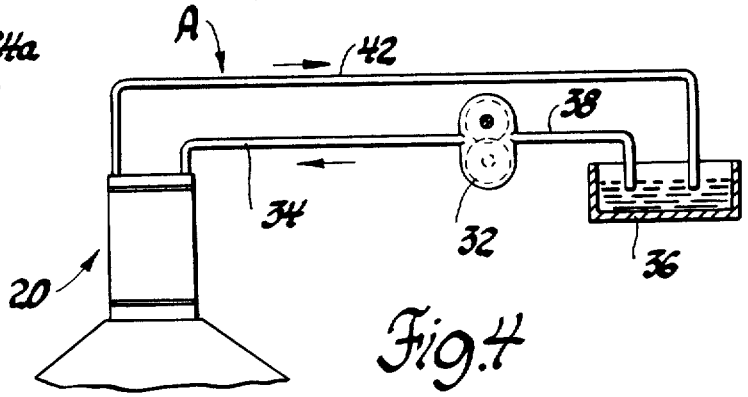
FIG. 4 is a partial schematic view of the paint spray apparatus of the present invention.

As best shown in FIG. 4, each valve assembly 20 has an inlet or inlet means 30 which is in communication with an outlet of a suitable pump 32 via a conduit 34. The pump has an inlet which is in communication with a suitable paint reservoir 36 via a conduit 38. The valve assembly 20 also has an outlet or outlet means 40 which is in communication with the reservoir 36 via a conduit 42. It should thus be apparent that the pump 32, when operating, continuously recirculates paint from the reservoir 36 through the valve assembly 20 and back to the reservoir 36. Each of the valve assemblies 20 would be connected to a reservoir in the same manner as that described in connection with FIG. 4 except that a different paint color would be in the reservoir.

Figure 2:
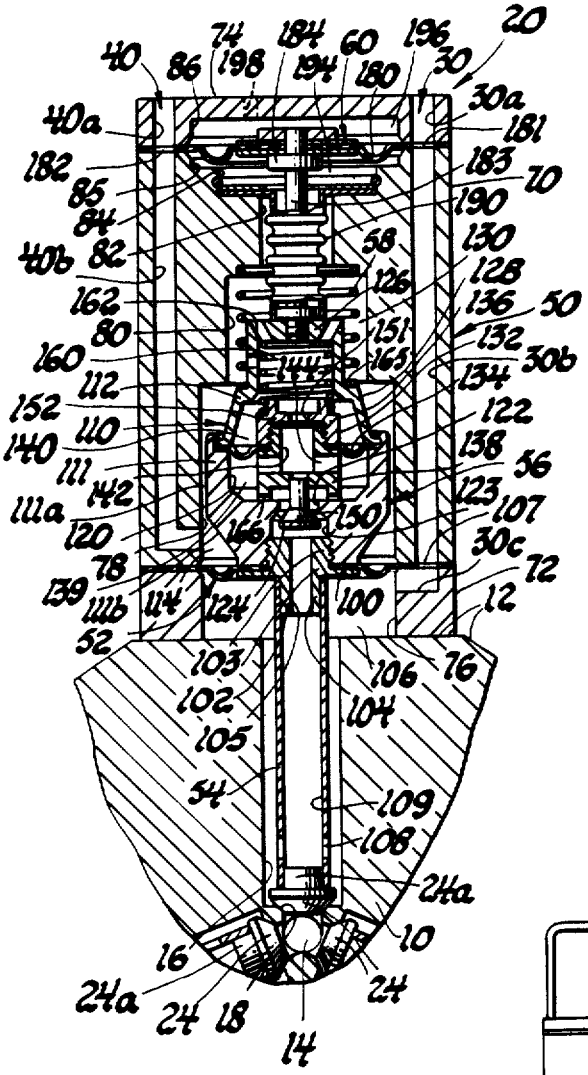
FIG. 2 is a fragmentary cross-sectional view taken along the lines 2—2 of FIG. 1.
Figure 3:
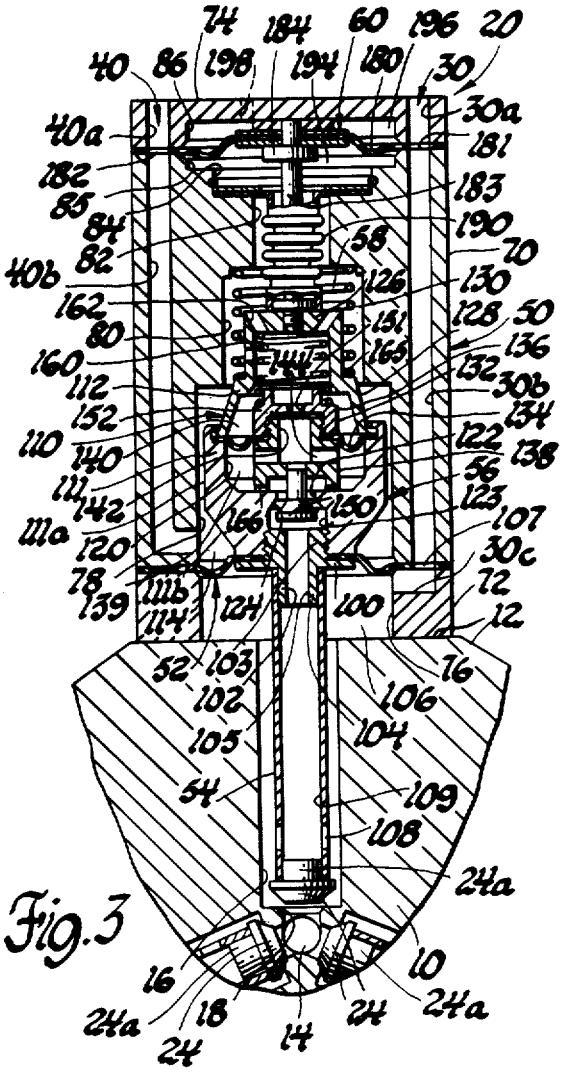
FIG. 3 is a cross-sectional view like that shown in FIG. 2 but showing different parts thereof in different positions.

The valve assembly 20 comprises, in general, a housing means 50, a first diaphragm means or diaphragm 52 which is operatively connected with the poppet valve 24 via a tube 54, a pressure compensating flow regulator means or assembly 56 supported by said diaphragm means 52 for controlling the rate of fluid flow through the valve assembly 20, a spring means 58 for normally biasingly holding the flow regulator means 56, diaphragm means 52 and poppet valve 24 in the position shown in FIG. 2 in which the poppet valve 24 blocks communication between the opening 16 and the main channel 14, and a second diaphragm assembly 60 operatively connected with the flow regulator means 56 and being responsive to pilot pressure to cause the flow regulator means 56, diaphragm assembly 52 and poppet valve 24 to be moved toward the position shown in FIG. 3 in which it communicates opening 16 with the main channel 14.

The housing means 50 of the valve assembly 20 is square shaped and comprises a main body member 70, an end member 72 and an end cap 74. The end member 72 has a central through opening 76 and abuts against the flat side 12 of the main body 10. The main body member 70 has a stepped central through opening to define a first diameter portion 78 along its lower end and which is of the same diameter as the opening 76 and the end member 72, a second diameter portion 80 which is of a lesser diameter than the diameter of the portion 78, a third diameter portion 82 which is of a lesser diameter than the portion 80, a fourth diameter portion 84 adjacent its upper end and which is of a greater diameter than the diameter of the portion 82, and a fifth diameter portion 85 which is of a greater diameter than the fourth portion. The end cap 74 has an axially extending recess or opening 86 which is of the same diameter as the diameter of the opening portion 84 and which faces the opening portion 84. The end cap 74 and the main body member 70 have aligned passages **30*a* and 30*b* therein, respectively, and the end member 72 has a radially extending passage 30*c* which is in communication with the passage 30*b*. The passages 30*a*, 30*b* and 30*c* define the inlet or inlet means 30. The end cap 74 and the main body portion 70 have aligned passages 40*a* and 40*b* which define the outlet or outlet means 40. The end member 72, the main body member 70 and the end cap 74 are retained in their assembled relation on the main body 10 via bolts 90 located at the corners of the valve housing means 50. The bolts 90 extend through all three members 74, 70 and 72 and are threadably received in suitable threaded openings (not shown) in the main body 10**.

The diaphragm means 52 has its outer periphery clamped between the end member 72 and the body member 70 of the housing means 50 and its inner periphery secured to an annular flange 100 of an annular metal member 102. The member 102 has an axially extending upper portion 103 provided with an external thread and an axially projecting lower portion 104 which is welded or otherwise secured to the upper end of the tube 54. The member 102 has a central through opening 105. The diaphragm means 52 with the end member 72 and the side 12 of the main body 10 defines a chamber 106 which is in communication with the inlet 30. The diaphragm has a suitable aperture 107 for communicating the passage portions **30*b* and 30*c***.

The tube 54 extends through the radially extending openings 16 in the main body 10 and has an external diameter which is less than the diameter of the opening 16, as shown in FIG. 2. The tube at its lower end is welded or otherwise secured to an axially extending portion **24*a* of the poppet valve 24. The tube 54 closely adjacent the poppet valve 24 includes a plurality of radial openings 108 to provide communication between the opening 16 and the interior 109 of the tube 54**.

The diaphragm means 52 carries the flow regulator means or assembly 56. The flow regulator means 56 is substantially identical to the pressure compensating flow control valve assembly disclosed in Applicant's copending patent application, filed concurrently herewith, and assigned to the same assignee as the present invention and identified by assignee's Ser. No. 525,127, filed 8/22/83. Resort may be had to this application for a detailed description thereof. Accordingly, the flow regulator means 56 will be described herein only to the extent necessary for a full understanding of the present invention.

The flow regulator means 56 comprises a housing means 110 having lower housing member 111 and an upper housing member 112 whose adjacent ends are suitably secured together. The lower housing member 111 has a cylindrical side wall portion **111*a* which has an outer diameter which is less than the diameter of the opening portion 78 and a tapered side wall portion 111*b* which tapers inwardly from the cylindrical side wall portion 111*b* and which with the housing member 70 and the diaphragm means 52 defines an annular chamber or cavity 114. The lower housing member 111 has a central through opening therethrough including an upper large diameter portion 120, an intermediate small diameter portion 122 and a lower portion 123 having a slightly larger diameter than the portion 122. The opening portions 122 and 123 at their juncture define an annular valve seat 124. The lower opening portion 123** is internally threaded and is threadably connected to the threaded projecting portion 103 of the member 102 to secure the flow regulator means 56 to the diaphragm means 52 and to clamp the inner periphery of the diaphragm 52 therebetween.

The upper housing member 112 is cup-shaped to define a bottom or end wall 126 and an annular side wall 128. The upper housing member 112 defines with the housing member 70 a cavity or chamber 130.

The housing means 110 supports a control valve means 132. The control valve means 132 comprises a flexible diaphragm 134 whose outer periphery is clamped between the upper and lower housing members 111 and 112 and whose inner periphery is clamped between upper and lower valve members 136 and 138. The diaphragm 134 defines with the lower housing member 111 a cavity or chamber 139 and defines with the upper housing member 112 a cavity or chamber 140. The lower valve member 138 is an annular stepped member having an axially extending opening 142 along its upper end and radially extending openings 144 intermediate its upper and lower ends which communicate the chamber 139 to the axially extending opening portion 142. The valve member 138 at its lower end carries a poppet valve 150 which is adapted to seat against the valve seat 124 of the lower housing member 111.

The upper valve member 136 is cup-shaped and is threadably secured to the upper threaded end of the bottom valve member 138 and clamps the inner periphery of the diaphragm 134 to the lower housing valve member 138. The upper valve member 136 has an axially extending opening or control orifice 151 through its end wall 152 which is of a given diameter to provide a predetermined pressure drop thereacross. The orifice 151 communicates the opening 142 to the chamber 130.

The control valve means 132 is normally biased to a position in which the poppet valve 150 is unseated from its valve seat 124 to allow communication between the hollow tube 54 and the chamber 139 by a spring means 160. The spring means 160 is in the form of a coil spring having one end in abutting engagement with the end wall 152 of the valve member 136 and its other end in abutting engagement with the end wall 126 of the cup-shaped upper housing member 112. The operation of the valve means 132 will be hereinafter described in more detail.

The end wall 12 of the housing member 112 is provided with a plurality of apertures 162 for communicating the chamber 130 with the chamber 140.

The poppet valve 24, tube 54, diaphragm assembly 52 and the housing means 110 are normally biased to the position shown in FIG. 2 in which the poppet valve 24 engages the valve seat 18 to block communication between the passage 16 and the common channel 14 by the spring means 58. The spring means is in the form of a coil spring having one end in abutting engagement with the housing member 70 at the juncture between the opening portions 80 and 82 and its other end in abutting engagement with the upper housing member 112. The upper housing member 112 has an annular shoulder 165 which is engaged by the spring means 58.

When the poppet valve 24 is in its closed position, as shown in FIG. 2, paint from the pump 32 is circulated through the conduit 34 to the inlet 30. The paint flows from the inlet 30 into the chamber 106 and then through the annular opening between the tube 54 and the inner diameter of the passage 16 and thence through the apertures 108 adjacent the poppet valve 24. Fluid then flows upwardly through the tube 54 through openings 105 and 123 and thence around the poppet valve 150 into the chamber 139. The paint as it flows into chamber 139 is directed against the bottom of the valve member 138 and then reversely flows and is directed laterally around an annular skirt 166. The paint then flows upwardly in chamber 139 and then laterally via apertures 144 into opening 142. From opening 142 the paint flows through the orifice 151 into the chamber 140 and then via openings 162 in the housing member 112 to chamber 130. The flow of paint from chamber 130 is then directed downwardly around housing means 110 and through the clearance between the side wall **111*a* of the housing member 111 to cavity or chamber 114. From cavity 114, the paint flows through the outlet 40 and back to the reservoir 36 via conduit 42**.

It should be apparent from the above that the paint is recirculated throughout the system and throughout the valve assembly 20. It should also be apparent that the paint is recirculated right up to the poppet valve 24 and then out through the valve assembly 20 in a manner such that no cavities exist through which the paint does not flow. This keeps the paint in an agitated state as it is recirculated and prevents pigments or solids in the paint from settling out anywhere in the system.

The clearance between the side **111*a* of the housing member 111 of the regulator means 56 is such that a pressure differential exists between chamber 130 and chamber 114, the latter pressure being somewhat lower. The forces acting on the diaphragm 52 and the tapered side 111*b* due to the pressure in chamber 114 are essentially balanced. The force acting on the diaphragm 52 due to the pressure of the fluid in chamber 106 is greater than the force acting on the housing means 110 due to the pressure of the fluid in chamber 130 which tends to unseat the poppet valve 24. The poppet valve 24, however, normally remains seated in its closed position due to the force of the spring means 58 acting in concert with the pressure in chamber 130, the concerted force being greater than the opposing force against the diaphragm 52 created by the pressure in chamber 106. The net resultant forces are such that the poppet valve 24 is biased into engagement with its seat 18 under a relatively light load or force. This allows for a substantially balanced loading across the diaphragm 52, which seals off chambers 106 and 114**, and increases its life.

The valve means 132 provides for a predetermined pressure drop across the orifice 151 and provides for a constant rate of flow of the recirculating paint therethrough. Any variation in pressure in chamber 140 will cause the poppet valve 150 to be moved toward or from its seat to maintain a constant rate of flow through the valve means 132. It should be noted that by causing the paint flow to flow around the poppet valve 150 thence laterally into the chamber 139 thence upwardly and then laterally through the ports 144 and then axially through opening 142 and thence through orifice 151 that the paint flows in a tortuous path so that the paint will be agitated. This will prevent or minimize pigments in the paint from settling out while flowing through the valve means 132.

When it is desired to deliver paint from the reservoir 36 to the main channel 14, the diaphragm assembly 60 will be deflected upwardly to unseat the poppet 24 from its valve seat 18 and allow paint to flow from the openings 16 into the main channel 14. The diaphragm assembly 60 comprises a flexible diaphragm 180 whose outer periphery is clamped between the end member 74 and the main body member 70 of the housing means 50. The diaphragm 180 includes a pair of apertures 181 and 182 for communicating passage portions 30*a* and 30*b* and passage portions 40*a* and 40*b*, respectively. The diaphragm means 60 also includes a stem 183 which is threadably secured to the upper end 126 of the housing member 112 of the housing means 110 and which is suitably secured via fastening means 184 to the diaphragm 180. Surrounding the stem member 183 is a flexible bellows 190 which has one end sealably secured to the end wall 126 of the housing member 112 and its other end sealably secured to the main body member 70 at the juncture of the opening portions 84 and 85.

The diaphragm 180 defines with the body member 70 and bellows 190 a cavity 194 and defines with the end member 74 a cavity 196. The cavity 196 is vented to the atmosphere via a vent 198. The flexible bellows member 190 prevents any fluid communication between the cavities or chambers 194 and 130. The chamber 194 is connected by a suitable port 199 to an air pilot line (not shown).

In operation, when it is desired to allow paint to flow to the main channels 14, an operator will connect the chamber 194 via port 199 to the air pilot line (not shown). When this occurs, air under pressure enters chamber 194 and causes the diaphragm 180 to be deflected upwardly, as shown in FIG. 3. When this occurs, the stem 183 will cause the housing means 110 of the flow regulator means 56 to be moved upwardly in opposition to the biasing force of the spring means 58. Upward movement of the housing means 110 in turn causes the diaphragm assembly 52 to be deflected upwardly which in turn causes the tube 54 and the poppet valve 24 to be moved upwardly to an open position, as shown in FIG. 3. When the poppet valve 24 is moved to its open position, paint will flow into the main channel 14 as well as be recirculated through the valve assembly 20 back to the reservoir 36. The pressure drop that occurs when the poppet valve 24 is moved to its open position is small such that most of the paint will be recirculated through the valve assembly 20 back to the reservoir 36. Any lessening in the flow rate will cause the valve means 132 to be moved slightly to regulate the pressure drop across the orifice 151 to cause a constant flow rate of paint.

From the foregoing, it should be apparent that a novel paint spray apparatus A has been provided in which the paint is constantly recirculated throughout the apparatus A so that no cavities exist which would allow pigments in the paint to settle out. It should also be apparent that the recirculated paint is recirculated throughout the valve assembly 20 right up to the poppet valve 24 and thence through the remainder of the valve assembly 20 back to the reservoir 36. It should also be apparent that by locating the pressure compensation flow valve means 56 within the main housing means 50 downstream of the poppet valve 24, that a relatively compact valve assembly 20 is provided and that the flow rate or pressure is regulated closely adjacent to the poppet valve 24.

Although the illustrated embodiment hereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. In a multi-color paint spray apparatus having a main body provided with a common paint applicator channel and a plurality of radially extending passages in communication with said main channel and terminating in valve seats adjacent said main channel, a valve assembly associated with each radial passage and being selectively operable to control discharge of one color of paint to the main channel, and means for constantly recirculating each color of paint from its source through its associated valve assembly and back to its source, said valve assembly comprising an outer housing means secured to said main body and surrounding one of said radial passages, an inlet in communication with said radial passage and said source, an outlet in communication with said source, a valve means including a valve poppet for engaging said valve seat, a stem tube having one end secured to said valve poppet and an outer diameter which is less than the diameter of the radial passage to define an annular space therebetween, said stem tube having transverse through apertures closely adjacent said poppet valve, deflectable diaphragm means carried by said housing means and dividing said housing means into a first chamber which is in communication with said inlet of said housing means and a second chamber which is in communication with said outlet, said diaphragm means having a central opening and being secured to said stem tube at its end remote from said poppet valve, spring means for biasing said valve means to a first position in which said poppet engages said valve seat to prevent discharge of paint into said common channel and to cause all of the paint to flow from the inlet of the housing means into said first chamber and annular space and thence into the stem tube via the transverse apertures in the stem tube whereby the paint caused to be recirculated up to the poppet valve and through all areas of the valve assembly to minimize pigments in the paint from settling out, and pressure responsive means operatively connected with said valve means for causing said valve means to be moved in opposition to the biasing force of said spring means to a second position in which said poppet is unseated to allow paint to flow therepast into the common channel.

2. In a multi-color paint spray apparatus having a main body provided with a common paint applicator channel extending axially of said body and a plurality of radially extending passages in communication with said main channel and terminating in valve seats adjacent said main channel, a valve assembly associated with each radial passage and being selectively operable to control discharge of one color of paint to the main channel, and means for constantly recirculating each color of paint from its source through its associated valve assembly and back to its source, said valve assembly comprising an outer housing means secured to said main body and surrounding one of said radial passages, an inlet in communication with said radial passage and said source, an outlet in communication with said source, a valve means including a valve poppet for engaging said valve seat, a stem tube having one end secured to said valve poppet and an outer diameter which is less than the diameter of the radial passage to define an annular space therebetween, said stem tube having transverse through apertures closely adjacent said poppet valve, deflectable diaphragm means carried by said housing means and dividing said housing means into a first chamber which is in communication with said inlet of said housing means and a second chamber, said diaphragm means having a central opening and being secured with said stem tube at its end remote from said poppet valve, a pressure compensated flow regulator located in said second chamber which is connected with said diaphragm means, said regulator having an inlet in communication with said central aperture in said diaphragm and an outlet in communication with said outlet in said housing means, spring means operatively connected with said valve means for biasing said valve means to a first position in which said poppet engages said valve seat to prevent discharge of paint into said common channel and to cause all of the paint to flow from the inlet of the housing means into said first chamber and annular space and thence into the stem tube via the transverse apertures in the stem tube whereby the paint is caused to be recirculated up to the poppet valve and through all areas of the valve assembly to minimize pigments in the paint from settling out, and pressure responsive means operatively connected with said valve means for causing said valve means to be moved in opposition to the biasing force of said spring means to a second position in which said poppet is unseated to allow paint to flow therepast into the common channel.

* * * * *